US006097825A

United States Patent [19]

Yoest et al.

[11] Patent Number: 6,097,825

[45] **Date of Patent: *Aug. 1, 2000**

[54] HEARING AIDS WITH STANDARDIZED SPHEROIDAL HOUSINGS

[75] Inventors: Robert Yoest, Deerfield; Greg Prutnikov, Niles; Miles Posen, Chicago, all of Ill.

[73] Assignee: Beltone Electronics Corporation, Chicago, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/716,109

[22] Filed: Sep. 19, 1996

[51] Int. Cl.[7] ..... H04R 25/00

[52] U.S. Cl. ..... 381/322; 381/328; 381/329

[58] Field of Search ..... 381/68.6, 68.7, 381/69.2, 69, 169, 168, 683, 322, 324, 325, 327, 328, 329, 330, 323, 326

[56] References Cited

U.S. PATENT DOCUMENTS

| | | | |
|---|---|---|---|
| 2,595,672 | 5/1952 | Greenwood | 381/322 |
| 3,448,224 | 6/1969 | Giller | 179/107 |
| 3,527,901 | 9/1970 | Geib | 381/322 |
| 3,983,336 | 9/1976 | Malek et al. | 179/107 FD |
| 4,150,262 | 4/1979 | Ono | 381/322 |
| 4,736,430 | 4/1988 | Schroder | 381/68.6 |
| 4,817,609 | 4/1989 | Perkins et al. | 381/322 |
| 5,002,151 | 3/1991 | Oliveira et al. | 381/68.6 |
| 5,046,580 | 9/1991 | Barton | 381/322 |
| 5,295,191 | 3/1994 | Van Vroenhoven | 381/328 |
| 5,310,163 | 5/1994 | Barton | 381/322 |
| 5,381,484 | 1/1995 | Claes et al. | 381/322 |
| 5,395,168 | 3/1995 | Leenen | 381/68.6 |
| 5,606,621 | 2/1997 | Reiter et al. | 381/68.6 |
| 5,701,348 | 12/1997 | Shennib et al. | 381/322 |

*Primary Examiner*—Curtis A. Kuntz
*Assistant Examiner*—Rexford N. Barnie
*Attorney, Agent, or Firm*—Rockey, Milnamow & Katz, Ltd.

[57] ABSTRACT

Hearing aids having housings formed as standardized shapes include electronic components. The components can be separate or integrated into a single unit. The housings can be formed as one or more spheroidal-like surfaces of revolution which are symmetrical along an axis. Alternately, the housings can be formed by lofting ellipses along a central axis. Representative housing shapes include egg-shaped and pear-shaped surfaces. An insertion and extraction element is fixedly attached to an end of the housing which extends toward the outer ear when the aid is inserted into an ear canal. The insertion/extraction member can be formed as either a rigid or a flexible element. The housing can carry a soft, deformable outer layer to improve performance and user comfort when installed in an ear canal.

16 Claims, 5 Drawing Sheets

HEARING AIDS WITH STANDARDIZED SPHEROIDAL HOUSINGS

FIELD OF THE INVENTION

The invention pertains to hearing aids. More particularly, the invention pertains to hearing aids having a standardized, spheroidal housing.

BACKGROUND OF THE INVENTION

Many known hearing aids are formed as custom products, especially adapted to properly fit a specific ear of a user. Such hearing aids and methods of making same are disclosed in prior printed publications and patents and would be known to those of skill.

Because many of the known hearing aids and methods of making same are oriented toward custom products intended to fit the ear of a single user, they do not benefit from the economics of scale that can be achieved using standard products. On the other hand, custom made hearing aids have been developed as a way to provide an improved fit and performance for a user.

So-called modular hearing aids are also known. These products combine a standardized electronic/battery module with one of a plurality of different size tips to provide a personalized aid from standard components.

Known hearing aids usually are intended to be properly located approximately at the same region of the ear from one user to another, irrespective of ear size or shape. That is to say, the body or housing size of an aid for an individual with a small ear canal would not normally be used with a person having a large ear canal as it might be loose or exhibit undesirable feedback due to gaps between the housing and the ear canal.

In view of the above, there is a continuing need to provide hearing aids which will fit properly in an individual's ear, yet will hopefully benefit from the economics associated with mass production. Preferably, such hearing aids will be comfortable to insert and remove and will comfortably fit in a user's ear canal and also minimize feedback problems.

SUMMARY OF THE INVENTION

Standardized hearing aid housings, which will comfortably and effectively fit into the ear canals of a variety of users, are formed as spheroids based on various geometric shapes. Such housings can be characterized as "one size fits all".

The housings carry an elongated insertion and removal element which can be gripped by a user for the purpose of inserting the housing into an ear canal or removing it therefrom. A single spheroidal shape is intended to be used with a large number of different ears, it is also intended that the spheroidal housing be inserted as far as possible into the respective ear canal by the user. Hence, in larger ears, the spheroidal may have a location further into the ear canal than would be the case with smaller ears.

The housings can be formed of molded plastic with or without a deformable, exterior coating. A deformable or sponge-like layer can be used to cover a spheroidal standardized housing. Alternately, the housings can be formed of a deformable material such as a high density sponge-like material.

When inserted, the spheroidal shapes exhibit either a concave or a convex exterior surface relative to a user's outer ear. This exterior surface, or the entire spheroid could be formed with a non-reflective, exterior. If desired, a black, non-reflective surface can be provided.

In one aspect of the invention, a spheroidal housing is formed by lofting an ellipse into an ellipse and then into a circle. In another embodiment of the invention, a housing is formed by revolving a spline around a central axis. Finally, in yet another embodiment of the invention, a housing is formed with an egg or pear-shaped exterior surface symmetrical about a center line.

In each of the above instances, the housing is intended to be formed substantially symmetrically about an axial center line and to fit into a plurality of different ear canals. Significantly different sizes of ear canals could be accommodated by a single or a limited number of different sizes of the standardized housings.

Hearing aids which embody the present invention immediately benefit from the economics of mass production. The various standardized housing shapes as described above are each intended to be useable with a variety of shapes and sizes of ear canals.

The respective housings, both deformable and non-deformable, each define a substantially closed interior region. Components such as microphones, processing circuitry, receivers and batteries can be carried in respective regions.

DETAILED DESCRIPTION

Figure 1A:
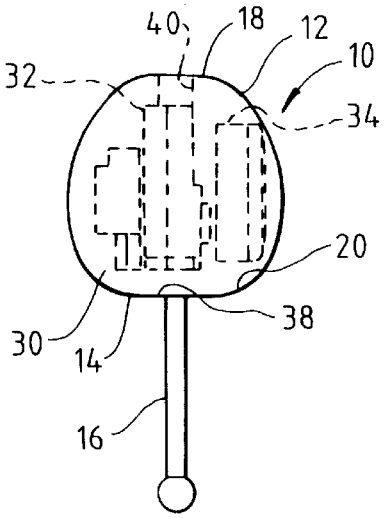
FIGS. 1A–1D taken together illustrate a plurality of different views of a standardized, spheroidal hearing aid body generated by revolving a spline around a central axis.
Figure 1B:
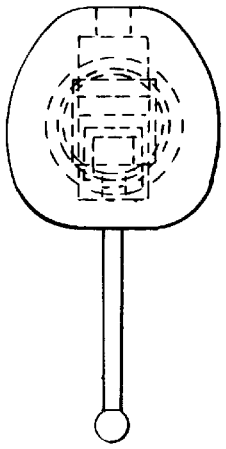
Figure 1C:
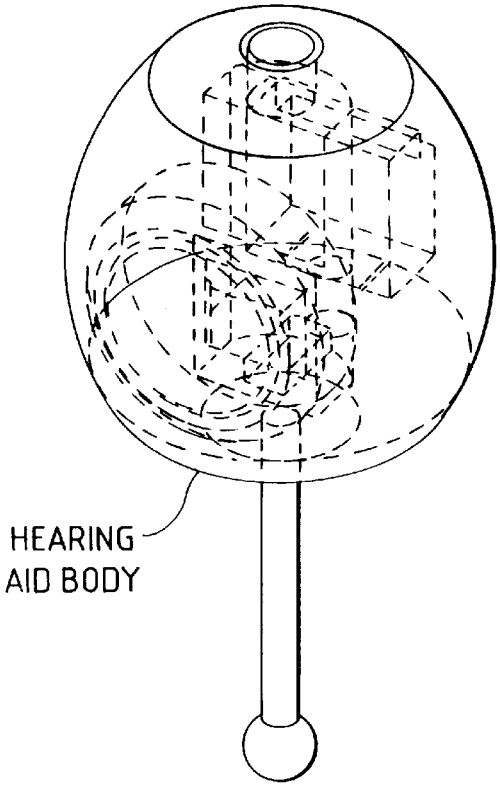
Figure 1D:
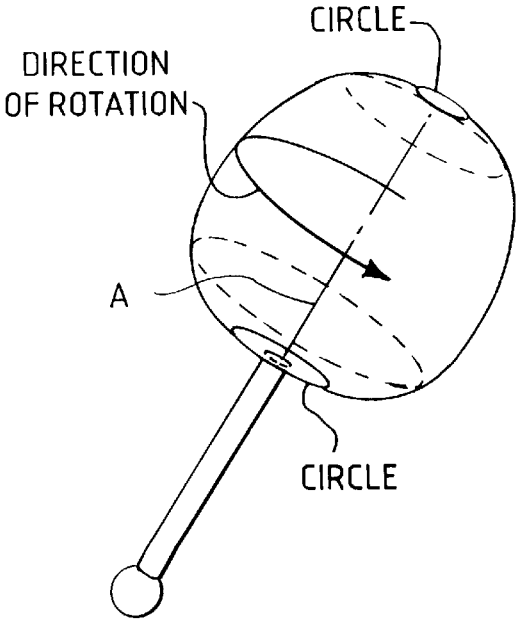

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIGS. 1A–1D illustrate various views of a hearing aid 10 having a standardized, spheroidal housing which is symmetrical about an axis A. The housing 12 is formed as a spheroid of revolution by rotating a spline about the axis A. Extending from a first surface 14 is an elongated extraction/insertion element 16. The element 16 is fixedly attached to the housing 12.

In use, the housing 12 is inserted into a user's ear canal with a surface 18 extending into the ear canal toward a user's ear drum. The surface 14 faces outwardly toward the outer ear of the user.

The exterior surfaces of the housing 12 between the end surfaces 14 and 18 slidably engage the surfaces of a user's ear canal much like known prior art hearing aids do. In the present instance, the housing 12 is formed with a standardized shape. As such, it can be molded very inexpensively and very high speed machinery which results in a very low cost.

With a standardized, one-size-fits-all shape, the unit 10 is intended to be inserted as far as possible into a user's ear canal using insertion/removal element 16. Hence, the unit 10 will have different operating locations from one ear canal to another.

The housing 12 defines an interior region 20 wherein operating components of the aid 10 can be located. Conventional controls can be carried on the surface 14.

As illustrated in FIGS. 1A through 1D, the hearing aid 10 can include a microphone 30, a receiver and processing circuitry 32 and a battery 34 located in the region 20. The microphone 30 is acoustically coupled to an input port indicated generally at 38 for the purpose of detecting and converting a received audio input into electrical signals in a known fashion.

The receiver and processing circuitry 32 convert audio input signals to audio output signals which are transmitted via a receiver output port 40 into the user's ear canal to an eardrum. It will be understood that the exact configuration of the components of the unit 10 is not a limitation of the present invention. For example, an integrated microphone/processor/receiver module could be used. Alternately, separate components could be used. Representative dimensions of the housing 12 and the extraction member 16 are illustrated in FIGS. 1A–1D.

Figure 2A:
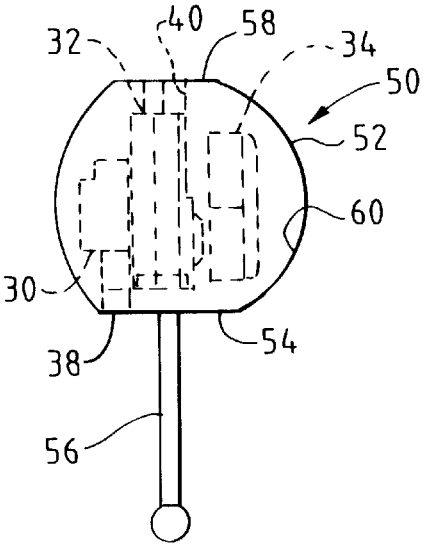
FIGS. 2A–2D taken together illustrate different views of a standardized hearing aid housing shape in accordance with the present invention formed by lofting an ellipse into ellipse into a circle.
Figure 2B:
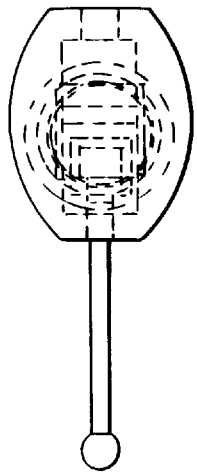
Figure 2C:
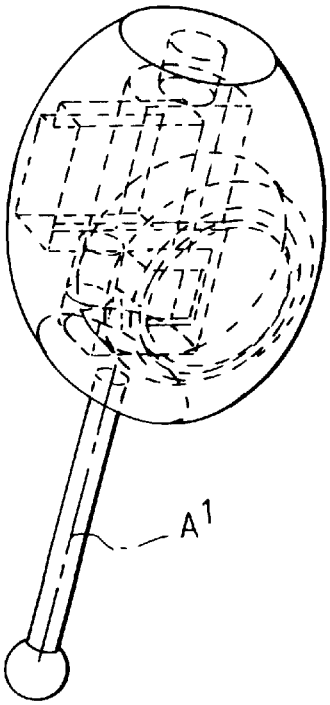
Figure 2D:
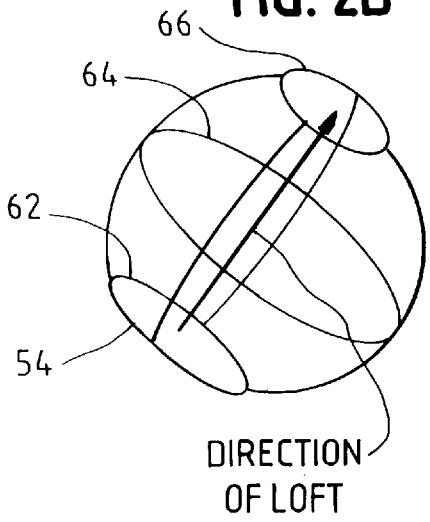

FIGS. 2A–2D illustrate a hearing aid 50 which includes a standardized spheroidal housing 52. The housing 52 is formed by lofting an ellipse 62 64 into a circle 66 as illustrated in FIG. 2D. Components such as microphone 30, receiver and processing circuitry 32 and battery 34 are numbered as described above in connection with housing 12.

Extending from a first surface 54 is an elongated extraction/insertion element 56. The housing 52 defines an interior region 60 wherein operating components of the aid 50 can be located.

Figure 3A:
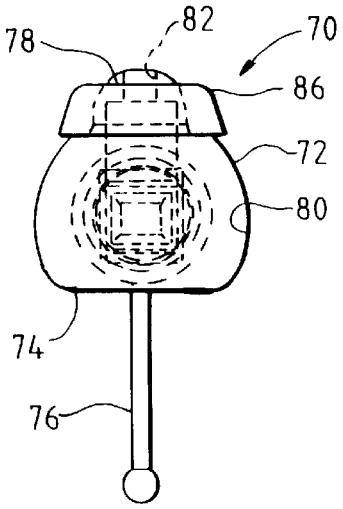
FIGS. 3A–3C taken together illustrate different views of a standardized body for a hearing aid symmetrically formed about a central axis and having a pear shape.
Figure 3B:
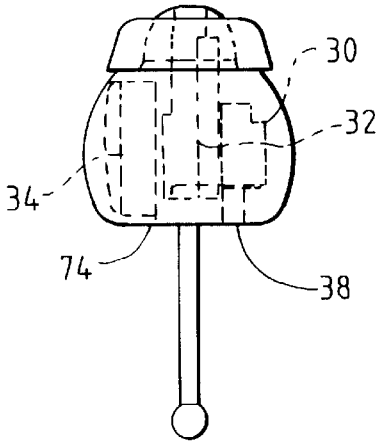
Figure 3C:
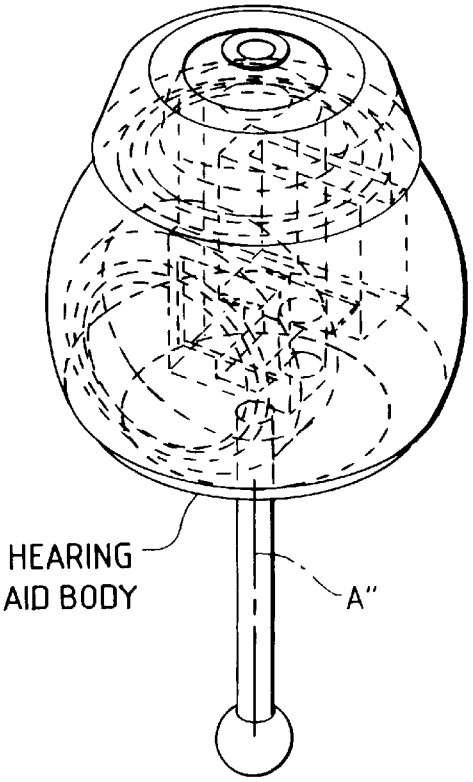

FIGS. 3A–3C illustrate various views of a pear-shaped hearing aid 70. The hearing aid 70 is formed symmetrically about an axis A".

The aid 70 includes a symmetrical pear-shaped housing 72 with a surface 74 which is intended to extend toward the outer ear, as was surface 14, when the aid 70 is inserted into the ear canal. It also includes an insertion/extraction element 76 which is fixedly attached to and extends from the surface 74 for insertion and removal. The element 76 can be semi-rigid or rigid to promote ease of insertion.

The aid 70 terminates in a surface 78 which, when inserted in an ear canal, is directed toward the user's ear drum. An internal region 80 provides space and carries a microphone 30, receiver and processing circuitry 32 and battery 34.

A microphone port 38 is formed on the surface 74 to provide access to the microphone 30 by incident audible sound. An output port 82 is provided in the surface 78 for the receiver and processing circuitry 32. A soft deformable ring 86 optionally can be carried on the housing 72 adjacent to the surface 78.

The housing 72 is formed as a surface of revolution about the axis A" similarly as was the housing 12. One of skill in the art will understand that other standardized housing shapes formed as surfaces of revolution would come within the spirit and scope of the present invention. Each of the standardized spheroidal housings could be covered by a deformable sponge-like coating to improve performance and user comfort.

The housings can be color coded for different sizes, shapes or performance characteristics. The economics of mass production might make such hearing aids inexpensive enough to be disposable when a new battery is needed or when invaded by ear wax.

Figure 4:
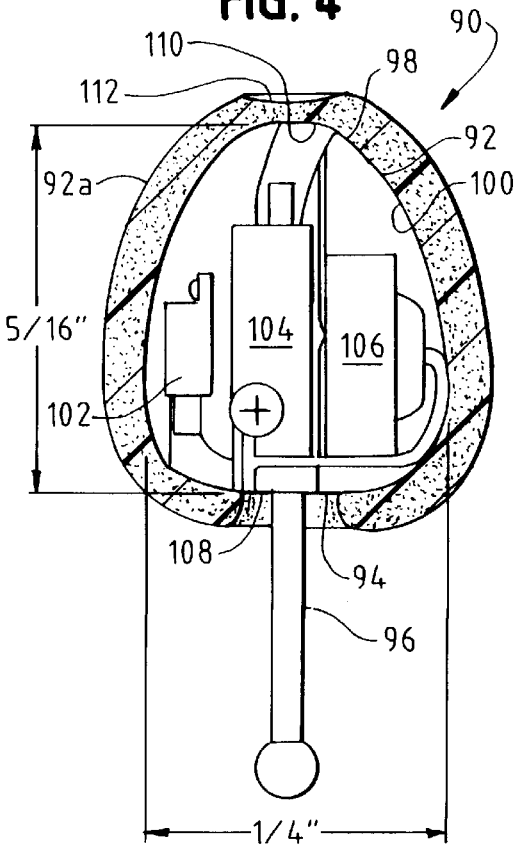
FIG. 4 is a side sectional view of another hearing aid in accordance with the present invention.

FIG. 4 illustrates a side sectional view of yet another embodiment of a hearing aid 90 in accordance with the present invention. The hearing aid 90 includes a spheroidal housing 92 which carries a deformable sponge-like coating or layer 92*a* The housing 92 could be formed in accordance with previously described standardized housings of FIGS. 1 through 3.

The purpose of the coating or layer of 92*a* is to increase the ease or comfort as well as overall performance of the hearing aid 90. It will be understood that the coating 92*a* could be formed of any suitable soft deformable material. The coating 92*a* could be provided in a variety of colors and densities to provide visual distinction between one hearing aid and another. The coatings can provide potentially different physiological effects when inserted into the ear canal of a user.

The housing 92 carries a first surface 94, which extends toward a user's outer ear when inserted into an ear canal. An insertion or extraction member 96 is affixed to the housing 92 adjacent to the surface 94. When the hearing aid 90 is inserted into an ear canal, the member 96 can be used to remove it.

The housing 92 carries a second surface 98 displaced from the surface 94. The surface 98 is directed in the ear canal toward the ear drum when the hearing aid 90 is inserted in the ear canal. The housing 92 defines an internal region 100 wherein various components are carried.

Representative components include a microphone 102, processing circuitry and receiver 104 and battery or source of electrical energy 106. The battery 106 can be permanently installed in the housing 92. Alternately, it can be replaceable.

An audio input port 108 extends through the surface 94 and couples the input of the microphone 102 to incident exterior audible sound waves. A receiver output port 110 extends through the surface 98 for the transmission of processed audio output signals to the user's inner ear canal and subsequently to the ear drum.

A damping and wax guard region 112, which could be part of the deformable layer 92A, is located adjacent to the output port 110. If desired, a separate wax guard which could be replaceable, could be provided.

The layer 92*a* can be removable. When removed, the battery 106 could be replaced by rotating or opening a portion of the housing 92 to expose the battery, replacing the battery and then reclosing the housing. The process of opening and closing the housing 92 can be carried out by rotating one portion of the housing relative to the other. Alternately, a rotatable battery replacement door could be provided.

Further, in view of the fact that the layer 92*a* is removable and replaceable, clear or color coded covers can be provided which indicate various types of processing circuitry present within the hearing aid 90. This color coding could also indicate different fitting characteristics when located in the user's ear canal. The layer 92*a* could also impart different fashion accents if desired. As is conventional in hearing aids, various controls for the hearing aid 90 can be provided on or adjacent to the exterior surface 94.

It will be understood that multiple blended or multiple independent interconnected spheroid elements could be used without departing from the spirit and scope of the present invention.

Figure 5A:
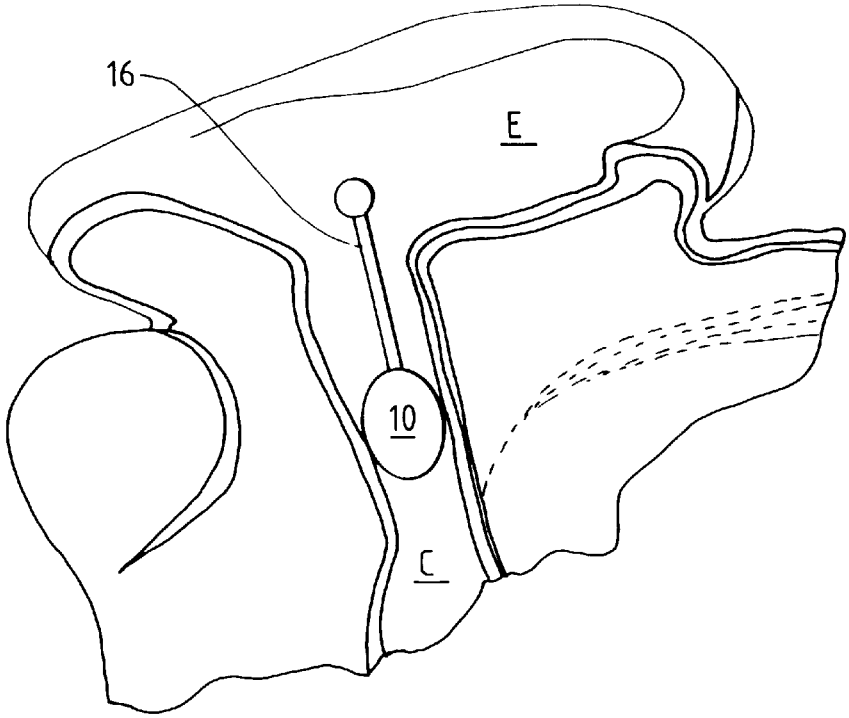
FIGS. 5A, 5B illustrating how different ears receive hearing aids in accordance with the present invention.
Figure 5B:
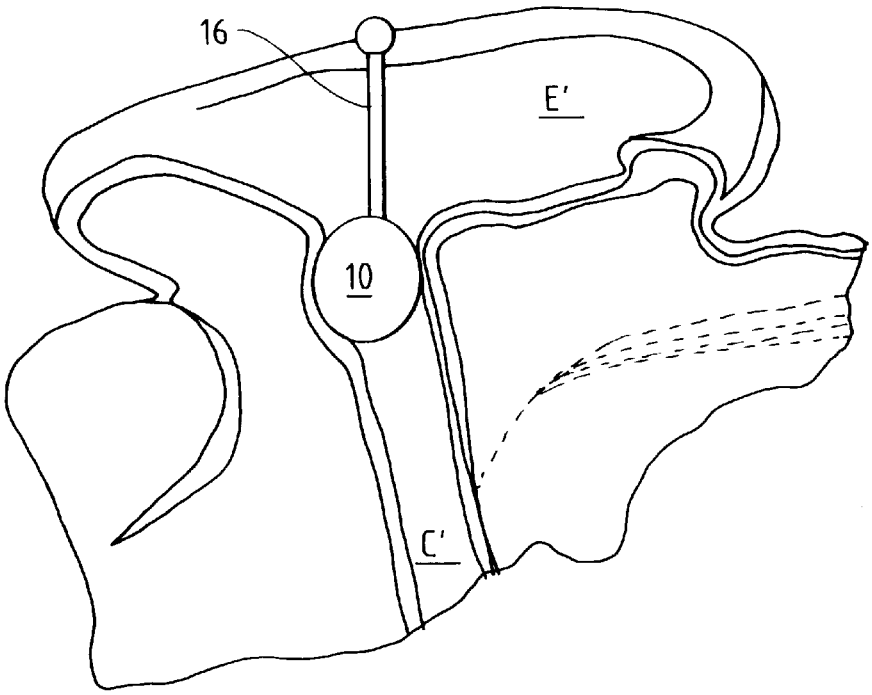

FIGS. 5A and 5B taken together illustrate the locations of a hearing aid, such as the hearing aid 10, in different sized ears. The hearing aid 10 has a standardized external housing 12.

As illustrated in FIG. 5A, with a larger ear E and an appropriately sized ear canal C, the hearing aid 10 is located further into the ear canal C then is the case of an ear E' as illustrated in FIG. 5B. In FIG. 5B the hearing aid 10 is positioned adjacent to the outer ear at the beginning of the ear canal C' unlike the situation illustrated in FIG. 5A where the hearing aid 10 is located further in the ear canal C further away from the outer ear.

Figure 6:
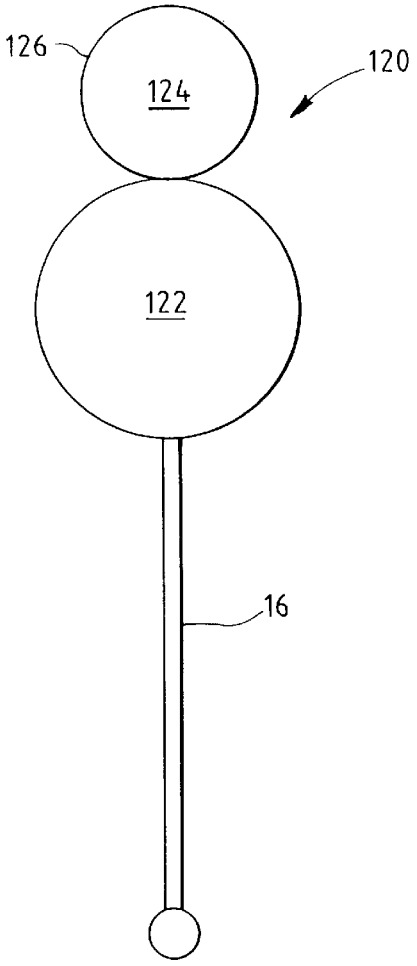
FIG. 6 illustrates an alternate embodiment of a hearing aid in accordance with the present invention.

FIG. 6 illustrates an alternate form of a hearing aid 120 in accordance with the present invention. The hearing aid 120 is formed of dual standardized, spheroidal, housings 122 and 124 which are coupled together. An insertion/extraction element 16 is attached to the housing element 122.

The spheroidal housing element 124, which can be rotatably coupled to the housing element 122 defines an audio output port 126. The spheroidal housing element 124 is intended to extend further into an ear canal than is the housing element 122.

The housing element 122 could include for example, a microphone, battery and processing circuitry. A receiver could be carried in part in the housing element 124. The insertion/extraction element 16 extends toward and is adjacent to a user's outer ear when the housing elements 122, 124 have been inserted into a user's ear canal.

Figure 7:
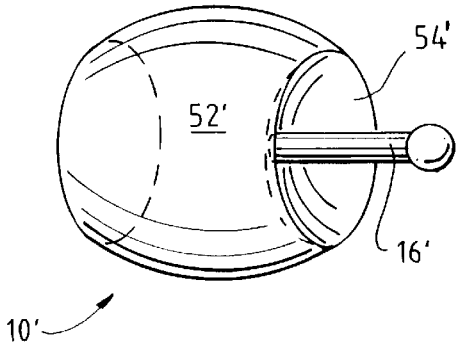
FIG. 7 illustrates another alternate embodiment of a hearing aid in accordance with the present invention.
Figure 8:
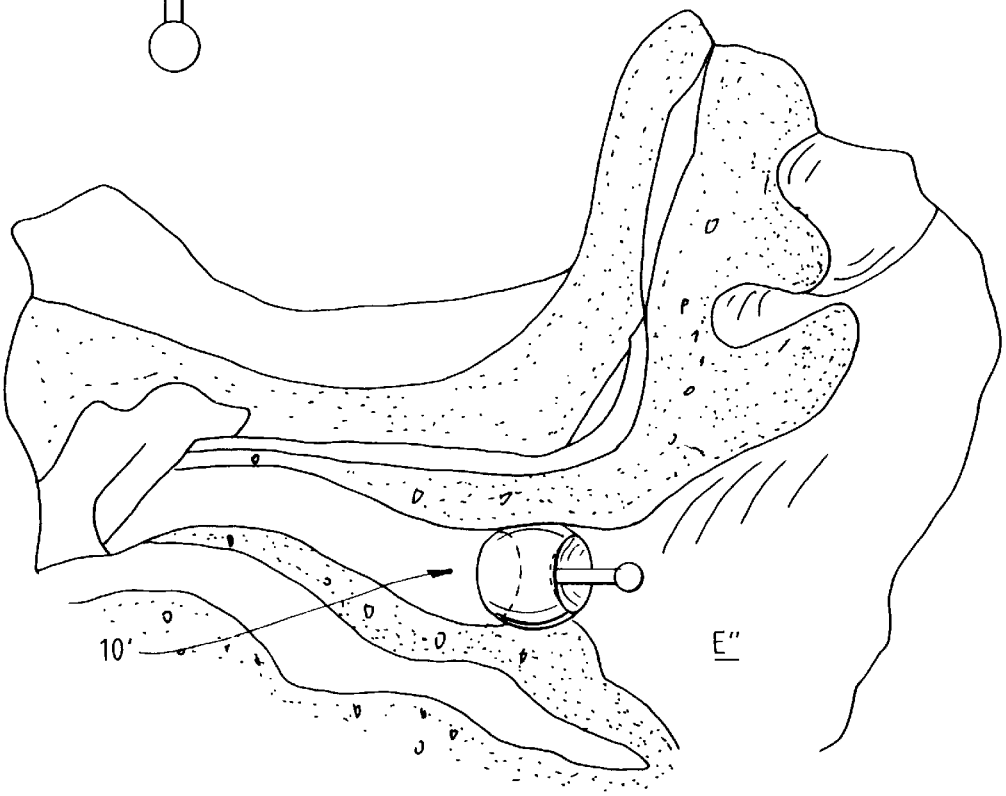
FIG. 8 illustrates how an ear might receive a hearing aid as illustrated in FIG. 7.

FIGS. 7 and 8 illustrate yet another embodiment of the present invention. In FIGS. 7 and 8, a hearing aid 10' has a spheroidal housing, such as the housing 52'. The housing 52' is formed with a concave surface 54'.

The concave surface 54', unlike a convex surface, may very well blend in with the shape of the users ear E". Extending from the concave surface 54' is an extraction member 16' of the type generally discussed previously.

It will be understood that a concave exterior surface, such as the surface 54' could be used in combination with other spheroidal housing shapes without departing from the spirit and scope of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A hearing aid usable with numerous different ear sizes comprising:

a microphone;

a spheroidal housing having an internal component receiving region containing said microphone, said housing intended to be inserted into a user's ear canal so as to minimize air gaps to avoid feedback and with an exterior surface of a selected curvature located adjacent to the user's outer ear when so inserted, said housing having a sound input port through said exterior surface, said sound input port open directly into the user's ear; and a substantially rigid, elongated, insertion element carried by said housing and extending toward the user's outer ear when the housing is inserted, said insertion element positioned on said exterior surface and having a longitudinal axis spaced from said sound input port; and wherein said selected curvature includes a concave surface facing a user's outer ear when said housing is inserted into the user's ear.

2. A hearing aid as in claim 1 wherein said housing defines an interior region; and audio processing components carried in said region.

3. A hearing aid comprising:

at least one standardized housing in the form of a substantially closed spheroid wherein said housing defines an internal component receiving region and wherein the spheroid has a shape which is intended to be inserted into a plurality of different ears;

an insertion member affixed to said housing and extending from a first surface thereof; and wherein said housing exhibits a concave surface facing a user's outer ear and a convex surface facing into the user's ear, when completely inserted into the user's ear canal.

4. A hearing aid usable with numerous different ear sizes comprising:

a spheroidal housing intended to be inserted into a user's ear canal so as to minimize air gaps to avoid feedback and with an exterior surface of a selected curvature located adjacent to the user's outer ear when so inserted; and a substantially rigid, elongated, insertion element carried by said housing and extending toward the user's outer ear when the housing is inserted; and wherein said selected curvature exhibits a concave surface facing a user's outer ear and said housing exhibits a convex surface facing into the user's ear, when completely inserted into the user's ear canal.

5. A hearing aid in claim 1 wherein said spheroidal housing has an external shape formed by lofting along a direction of insertion a first ellipse having unequal conjugate and transverse axes into a second different ellipse having unequal conjugate and transverse axes.

6. A hearing aid in claim 1 wherein said spheroidal housing has an external shape which is rotationally symmetrical about a central axis.

7. A hearing aid as in claim 1 wherein said housing is covered, at least in part, by a deformable outer layer.

8. A hearing aid as in claim 7 wherein said layer is removable and replaceable.

9. A hearing aid as in claim 3 wherein said substantially closed spheroid is formed by lofting along a direction of insertion a first ellipse having unequal conjugate and transverse axis into a second different ellipse having unequal conjugate and transverse axis.

10. A hearing aid as in claim 3 wherein said substantially closed spheroid has a shape rotationally symmetrical about a central axis.

11. A hearing aid as in claim 3 wherein said housing is covered, at least in part, by a deformable outer layer.

12. A hearing aid as in claim 11 wherein said layer is removable and replaceable.

13. A hearing aid as in claim 4 wherein said spheroidal housing has an external shape formed by lofting along a direction of insertion a first ellipse having unequal conjugate and transverse axes Into a second different ellipse having unequal conjugate and transverse axes.

14. A hearing aid as in claim 4 wherein said spheroidal housing has an external shape rotationally symmetrical about a central axis.

15. A hearing aid as in claim 4 wherein said housing is covered, at least in part, by a deformable outer layer.

16. A hearing aid as in claim 15 wherein said layer is removable and replaceable.

* * * * *